US009683577B2

(12) United States Patent
Rasmussen et al.

(10) Patent No.: US 9,683,577 B2
(45) Date of Patent: Jun. 20, 2017

(54) AXIAL BLOWER, A BLOWER ROTOR

(75) Inventors: Martin Rasmussen, Næstved (DK); Peter Holt, Næstved (DK)

(73) Assignee: NOVENCO A/S, Naestved (DK)

( * ) Notice: Subject to any disclaimer, the term of this patent is extended or adjusted under 35 U.S.C. 154(b) by 577 days.

(21) Appl. No.: 14/234,735

(22) PCT Filed: Jul. 31, 2012

(86) PCT No.: PCT/EP2012/064928
§ 371 (c)(1),
(2), (4) Date: Apr. 28, 2014

(87) PCT Pub. No.: WO2013/017584
PCT Pub. Date: Feb. 7, 2013

(65) Prior Publication Data

US 2014/0234101 A1 Aug. 21, 2014

(30) Foreign Application Priority Data

Aug. 4, 2011 (DK) ..... 2011 70429

(51) Int. Cl.
*F04D 29/36* (2006.01)

(52) U.S. Cl.
CPC ..... *F04D 29/36* (2013.01)

(58) Field of Classification Search
CPC ..... F04D 29/36
USPC ..... 415/129, 131, 187, 207, 218.1, 219.2, 415/220; 416/244 A, 244 B
See application file for complete search history.

(56) References Cited

U.S. PATENT DOCUMENTS 3,456,872 A 7/1969 Troller
3,561,883 A 2/1971 Perry
4,171,183 A * 10/1979 Cornell ..... B64C 11/00 416/223 R
4,934,904 A * 6/1990 Kennedy ..... F04D 29/34 416/135
4,978,286 A * 12/1990 Hurley ..... B64C 11/28 416/143

(Continued)

FOREIGN PATENT DOCUMENTS

CN 2165270 Y 5/1994
DE 949 899 9/1956

(Continued)

OTHER PUBLICATIONS

Jul. 3, 2015 Office Action issued in Chinese Patent Application No. 2012800387210.

(Continued)

*Primary Examiner* — Hoang Nguyen
(74) *Attorney, Agent, or Firm* — Oliff PLC

(57) ABSTRACT

An axial blower where each socket includes a device for mounting of a rotor blade out of the number of rotor blades being, at a proximal end, at the rotor hub, provided with a blade foot to the effect that the blade foot can be received and retained in the socket in such a manner that the rotor blade extends from the socket and radially outward from the hub surface on the rotor hub, and the blade foot and the socket are configured such that the rotor blade can be mounted and retained at two or more different angles about a blade axis extending from the rotor hub and completely or partially radially outwards from the rotor hub.

10 Claims, 3 Drawing Sheets

(56) References Cited

U.S. PATENT DOCUMENTS

| | | | | |
|---|---|---|---|---|
| 5,947,892 | A * | 9/1999 | Benkowski | A61M 1/10<br>415/900 |
| 6,928,963 | B2 * | 8/2005 | Karanik | F01P 5/02<br>123/41.63 |

FOREIGN PATENT DOCUMENTS

| | | | |
|---|---|---|---|
| WO | WO 96/23140 | A1 | 8/1996 |
| WO | WO 2011/044909 | A1 | 4/2011 |

OTHER PUBLICATIONS

Jun. 13, 2013 Search Report issued in International Patent Application No. PCT/EP2012/064928.
Jun. 13, 2013 Written Opinion issued in International Patent Application No. PCT/EP2012/064928.
Dec. 9, 2013 International Preliminary Report on Patentability issued in International Patent Application No. PCT/EP2012/064928.

* cited by examiner

AXIAL BLOWER, A BLOWER ROTOR

FIELD OF APPLICATION OF THE INVENTION

The present invention relates to axial blowers and in particular to a blower rotor for an axial blower.

Most often axial blowers comprise a substantially circular-cylindrical blower pipe having an internal diameter; and wherein, in the blower pipe, a blower rotor is configured, said blower rotor having a rotor shaft coinciding substantially with the centre axis of the circular-cylindrical blower pipe; and wherein the blower rotor comprises a centrally disposed rotor hub on which a number of rotor blades are configured.

Optionally the blower pipe may be provided with mounting flanges both upstream and downstream of the rotor, said mounting flanges extending substantially at right angles from the outside of the blower pipe, said mounting flanges comprising means for mounting the blower rotor in eg a tubing system for ventilation purposes.

STATE OF THE ART

Today, several different embodiments of axial blowers of the above-mentioned type are known, and, amongst them, eg from WO 2011044909, such axial blower is known wherein the rotor hub has, on its outside, a hub surface which is substantially rotary-symmetrical about the centre axis of the rotor hub; and wherein the rotor hub has a leading end and a trailing end, and a diverging section there between where the radius of the hub surface in the diverging section is increased by the distance to the leading end of the hub. Such configuration of the rotor hub has been found to yield a very high efficiency of the axial blower.

It is thus a constant challenge in the development of such axial blowers to achieve that, all other things being equal, and with a given motor power to operate the blower rotor, the highest possible pressure increase and/or the highest possible air throughput is/are achieved, while simultaneously the manufacturing and operating costs associated with the manufacture and operation of the axial blower are kept as low as possible.

OBJECT OF THE INVENTION

In the light of this, it is the object of the present invention to provide an axial blower of the kind described above, and which, to a higher degree than known axial blowers, enables that a high efficiency is obtained for the axial blower, while simultaneously reduced costs are obtained in respect of the manufacture and operation of the axial blower.

According to the invention, this is obtained by an axial blower and a blower rotor as set forth above which are characterised in that, in the rotor hub—within the diverging section on the hub surface, a number of sockets are provided in the blower rotor, said sockets extending into the rotor hub and forming an opening in the hub surface; and wherein each socket comprises means for mounting of a rotor blade being, at its proximal end, at the rotor hub, provided with a blade foot to the effect that it can be received and retained in the socket in such a manner that the rotor blade extends from the socket and radially outwards from the hub surface on the rotor hub.

According to a preferred embodiment, the axial blower is provided with mounting flanges both upstream and downstream of the rotor, said mounting flanges extending substantially at right angles from the outside on the blower pipe, said mounting flanges comprising means for mounting the blower rotor in a tubing system.

In particular low production costs are obtained in case the rotor hub and the blades are manufactured as separate, moulded metal parts.

According to a preferred embodiment of the invention, the blade foot and the socket are configured such that the blade can be mounted and retained at two or more different angles about a blade axis extending from the rotor hub and completely or partially radially outwards from same.

In this context, the blade foot may advantageously comprise a pivot which is configured to be substantially rotary-symmetrical about the blade axis, and on which a round-going collar is configured, and the socket may comprise a hole which is configured complementarily relative to the rotary-symmetrical pivot and the round-going collar which is configured with a view to receiving the rotary-symmetrical pivot.

According to a preferred embodiment, the opening in the hub surface has a periphery that extends along a circular-cylindrical surface with the blade axis as centre axis.

In this context, the socket preferably comprises a circular-cylindrical surface extending from the hub surface and a distance into the rotor hub and which has a diameter that corresponds to the circular-cylindrical surface.

This enables a particular high efficiency if the blade foot also comprises a flange covering the opening in the hub surface, said flange being configured such that it has a surface from where the blade extends, and which surface has a periphery which, when the blade is mounted on the rotor hub at a specific angle, is substantially flush with the hub surface at the periphery on the opening therein.

The flange surface is advantageously of such size that, when the blade is mounted on the surface of the flange, it divides the surface of the flange into two separate surfaces.

In this context, the leading edge of the blade, seen from in front of the rotor, advantageously extends substantially from the periphery on the surface of the flange, and further the trailing edge of the blade, seen from in front of the rotor, may be disposed outside the periphery on the surface of the flange.

LIST OF FIGURES

EMBODIMENT OF THE INVENTION

Figure 4:
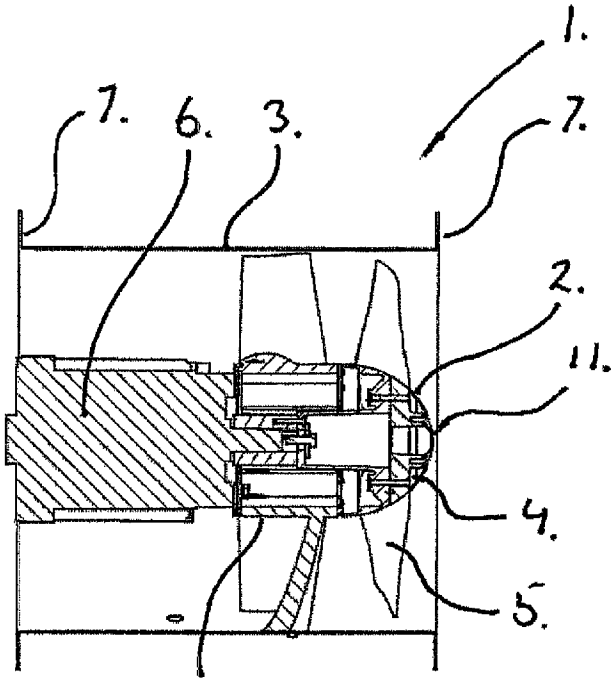
FIG. 4 is a sectional view through the axial blower shown in FIG. 3, seen from the side in a vertical sectional view through the centre axis of the axial blower.
Figure 3:
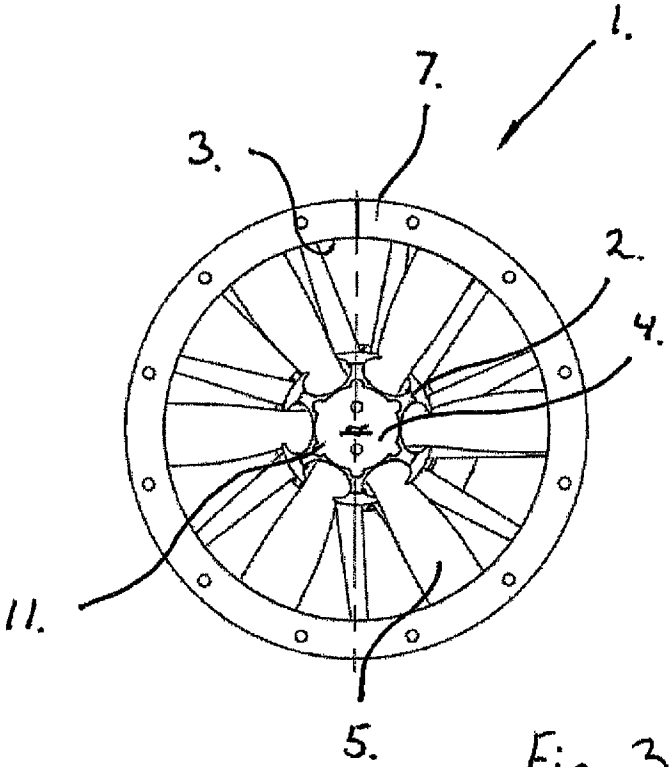
FIG. 3 shows an axial blower with a blower rotor according to the invention, seen from in front.

Thus, FIGS. 3 and 4 show an axial blower 1 according to the present invention, which axial blower 1 has a blower rotor 2 in the form of a propeller driven around by a motor 6, said blower rotor 2 having a rotor hub 4 being mounted on a rotor shaft driven around by the motor 6 about the centre axis of the rotor 2.

The rotor 2 is arranged centrally in a blower pipe 3 which has, at both its ends, a mounting flange 7 extending outwards from the blower pipe 3 and being provided with bolt holes for mounting of the axial blower 1 in a tubing system, such as a ventilation system, where it serves to force air through the tubing system. However, the axial blower may also be used as a free blower.

Additionally, the rotor 2 has a set of rotor blades 5 that extend radially from the rotor hub 4 and out towards the blower pipe 3, where the rotor blades 5 end a short distance from the inner side of the blower pipe 3 to the effect that a small tip clearance is established between the outermost end of the rotor blade 5 and the inner side of the blower pipe 3.

The blower rotor 2 as such is configured with a rotor hub 4 having a hub surface 11 diverting outwards in a direction from the leading end of the rotor hub 4 and rearwards in a direction towards the trailing edge of the rotor hub 4. In the shown embodiment, the rotor hub 4 is configured as a part of a paraboloid, but, according to the invention, the shape may vary with due regard to optimisation of the shape of the rotor hub 4 to a specific purpose.

Figure 2:
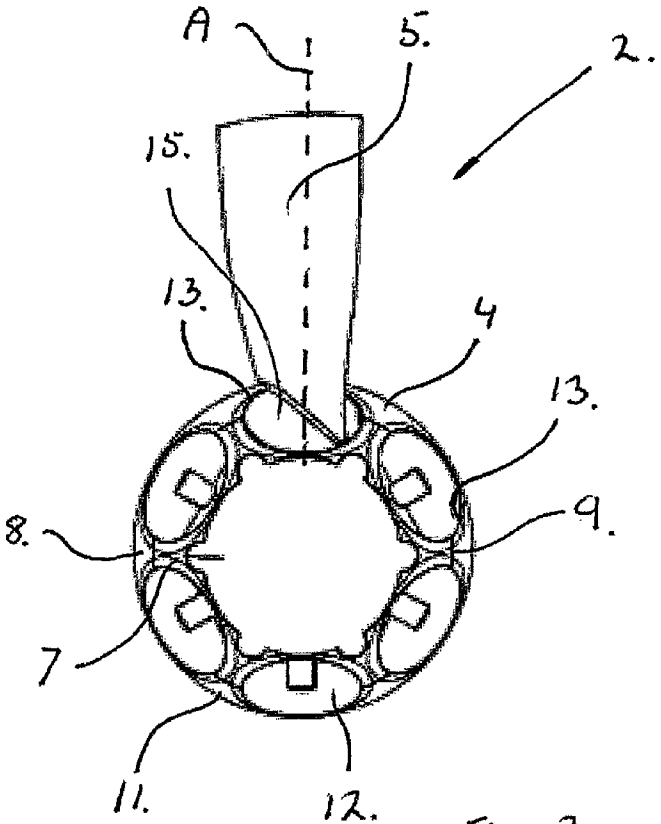
FIG. 2 shows the blower rotor according to FIG. 1, seen from in front, but with only one rotor blade mounted.
Figure 1:
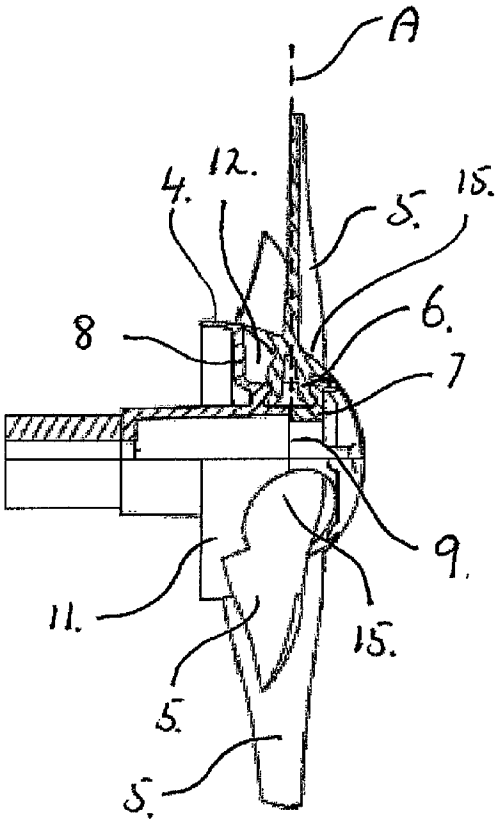
FIG. 1 is a partially sectional view through a blower rotor according to the invention, seen from the side.

According to the invention, as shown in detail in FIGS. 1 and 2, a number of sockets 12 are provided in the shape of holes or openings extending from the hub surface 11 and into the rotor hub 2 and having, at the hub surface, a periphery 13 which is on a cylinder face with the blade axis A as centre. In each of those holes it is possible to mount a blade 5 having a blade foot 6 configured as a pivot which has a certain rotary-symmetry about the blade axis A to the effect that, when that tap 6 is mounted in a complementarily configured part of the socket 12, the blade 5 may rotate about the blade axis A.

In order to enable mounting and dismounting and adjustment of the blade 5 relative to the rotor hub 4, the rotor hub 4 is divided into two parts, viz a leading part 7 and a trailing part 8 that can be assembled and separated along the separating line 9. Here, assembly of the leading part 7 and the trailing part 8 takes place by means of a number of bolts that are not shown in the drawing, but it will be natural to the person skilled in the art to point to various methods to that end.

Figure 6:
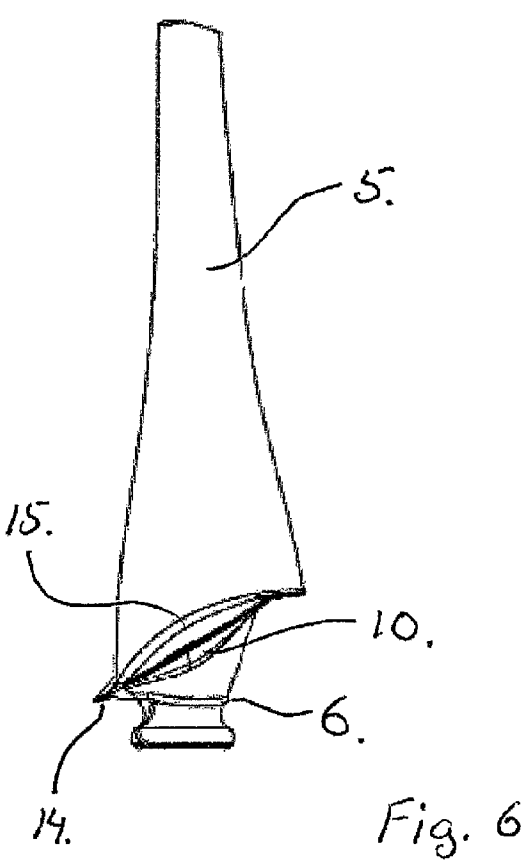
FIG. 6 shows the rotor blade according to FIG. 5, seen from one side.
Figure 5:
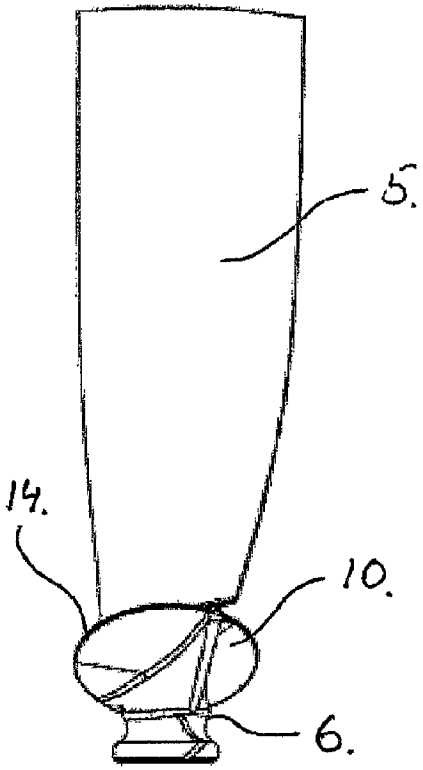
FIG. 5 shows a rotor blade, seen from behind.

FIGS. 5 and 6 show a blade 5 according to the invention, which blade 5 has a blade foot in the form of a pivot 6. Between the blade 5 and the blade foot 6, a flange 10 is provided which has a periphery 14 being of the same shape as the periphery 13 on each of the openings or holes in the sockets 12 and which is configured such that, when the blade 5 is mounted in a specific position in a socket 12, the periphery 14 on the flange 10 will be flush with the periphery 13 on the opening in the socket 12 as it is shown in FIGS. 1 and 2. Thereby the collar 10 forms a lid that closes the opening in the socket 12 to the effect that turbulence around the socket is minimised.

However, in case the blade is rotated a small distance from that position about its axis of rotation A, the periphery 14 on the collar 10 will be shifted only a small distance away from the periphery 13 on the opening in the socket 12, which will, however, create only minimal turbulence if the blade 5 is rotated less than 30 degrees from the optimum angle.

In the shown embodiment, the collar 10 has a surface 15 which is substantially flush with the hub surface 11, and it has essentially the same curvature as the latter. Moreover, the blade 5 is mounted such that it extends from the surface 15 in such a manner that it divides the surface 15 into two separate parts.

The invention claimed is:

1. An axial blower comprising a substantially circular-cylindrical blower pipe having an internal diameter;

a blower rotor configured in the blower pipe, wherein:

the blower rotor has a rotor shaft coinciding substantially with a center axis of the circular-cylindrical blower pipe;

the blower rotor comprises a centrally disposed rotor hub on which a number of rotor blades are configured, said rotor hub having, on an outside, a hub surface which is substantially rotary-symmetrical about a center axis of the rotor hub, the rotor hub has a leading end and a trailing end, and a diverging section there between where a radius of the hub surface in the diverging section is increased by distance to the leading end of the rotor hub, in the rotor hub, within the diverging section on the hub surface, a number of sockets are provided in the blower rotor, said sockets extending into the rotor hub and forming an opening in the hub surface;

each socket comprises means for mounting of a rotor blade out of the number of rotor blades being, at a proximal end, at the rotor hub, provided with a blade foot to the effect that the blade foot can be received and retained in the socket in such a manner that the rotor blade extends from the socket and radially outward from the hub surface on the rotor hub, and the blade foot and the socket are configured such that the rotor blade can be mounted and retained at two or more different angles about a blade axis extending from the rotor hub and completely or partially radially outwards from the rotor hub.

2. A axial blower according to claim 1, wherein:

the blower pipe is provided with mounting flanges both upstream and downstream of the rotor, said mounting flanges extending substantially at right angles from an outside of the blower pipe, and said mounting flanges comprising means for mounting the blower rotor in a tubing system.

3. A blower rotor according to claim 1, wherein the rotor hub and the rotor blades are made as separate molded metal parts.

4. A blower rotor according to claim 1, wherein:

the blade foot comprises a pivot which is configured to be substantially rotary-symmetrical about the blade axis, and on which a round-going collar is configured; and the socket comprises a hole which is configured complementarily relative to the rotary-symmetrical pivot and the round-going collar is configured with a view to receiving the rotary-symmetrical pivot.

5. A blower rotor according to claim 1, wherein the opening in the hub surface has a periphery that extends along a circular-cylindrical surface with the blade axis as the center axis.

6. A blower rotor according to claim 5, wherein the socket comprises a circular-cylindrical surface extending from the hub surface and a distance into the rotor hub and which has a diameter that corresponds to the circular-cylindrical surface.

7. A blower rotor according to claim 6, wherein the blade foot comprises a flange covering the opening in the hub surface, said flange being configured such that the flange has a surface from where the blade extends, and the surface has a periphery which, when the blade is mounted on the rotor hub at a specific angle, is substantially flush with the hub surface at the periphery on the opening therein.

8. A blower rotor according to claim 7, wherein the blade is mounted such on the surface of the flange the blade divides the surface of the flange into two separate surfaces.

9. A blower rotor according to claim 7, wherein a leading edge of the blade, seen from in front of the rotor, extends substantially from the periphery on the surface of the flange.

10. A blower rotor according to claim 7, wherein a trailing edge of the blade, seen from in front of the rotor, is disposed outside the periphery on the surface of the flange.

* * * * *